US007642976B2

(12) United States Patent
Taniguchi et al.

(10) Patent No.: US 7,642,976 B2
(45) Date of Patent: Jan. 5, 2010

(54) AM/FM RECEIVING ANTENNA

(75) Inventors: Tatsuaki Taniguchi, Hiroshima (JP); Kazuo Shigeta, Hiroshima (JP)

(73) Assignee: Mazda Motor Corporation (JP)

( * ) Notice: Subject to any disclaimer, the term of this patent is extended or adjusted under 35 U.S.C. 154(b) by 12 days.

(21) Appl. No.: 11/962,569

(22) Filed: Dec. 21, 2007

(65) Prior Publication Data

US 2008/0169990 A1 Jul. 17, 2008

(30) Foreign Application Priority Data

Jan. 12, 2007 (JP) ..... 2007-005020

(51) Int. Cl.
*H01Q 1/32* (2006.01)

(52) U.S. Cl. ..... 343/713

(58) Field of Classification Search ..... 343/711–714
See application file for complete search history.

(56) References Cited

U.S. PATENT DOCUMENTS

| | | | | |
|---|---|---|---|---|
| 5,083,133 | A * | 1/1992 | Takayama | 343/704 |
| 5,610,619 | A | 3/1997 | Zafar | |
| 5,646,637 | A * | 7/1997 | Miller | 343/713 |
| 5,963,585 | A * | 10/1999 | Omura et al. | 375/150 |
| 6,576,845 | B2 * | 6/2003 | Von Alpen et al. | 174/149 R |
| 2003/0058178 | A1 * | 3/2003 | Von Alpen et al. | 343/713 |
| 2003/0080909 | A1 * | 5/2003 | Voeltzel | 343/713 |
| 2003/0112190 | A1 * | 6/2003 | Baliarda et al. | 343/713 |
| 2005/0195114 | A1 * | 9/2005 | Yegin et al. | 343/713 |
| 2008/0158075 | A1 * | 7/2008 | Villarroel et al. | 343/713 |

FOREIGN PATENT DOCUMENTS

| | | |
|---|---|---|
| EP | 1643587 A1 | 4/2006 |
| JP | 2003-152415 | 5/2003 |
| WO | 02/075844 A1 | 9/2002 |

OTHER PUBLICATIONS

European Search Report; EP 07024552; Jun. 16, 2008.

* cited by examiner

*Primary Examiner*—Huedung Mancuso
(74) *Attorney, Agent, or Firm*—Studebaker & Brackett PC; Donald R. Studebaker

(57) ABSTRACT

There is provided an AM/FM receiving antenna, which is provided at a windowpane of a vehicle, comprising an AM antenna element including an end portion as a power supply point and another end portion forming an open end, and an AM/FM antenna element connected to the AM antenna element via the power supply point, wherein a distance L between the end portion and the another end portion of the AM antenna element, a reduction ratio $\alpha$ of a material of the windowpane, a minimum wavelength $\lambda_{min}$ of a receiving FM frequency band, and a maximum wavelength $\lambda_{max}$ of the receiving FM frequency band meet a requirement equation of $\alpha\cdot\lambda_{min}/2 \leqq L \leqq \alpha\cdot\lambda_{max}/2$. The AM/FM receiving antenna can properly achieve the compatibility of receiving sensitivity of the AM and FM electric waves, having a smaller layout space for antenna elements.

8 Claims, 2 Drawing Sheets

AM/FM RECEIVING ANTENNA

BACKGROUND OF THE INVENTION

The present invention relates to an AM/FM receiving antenna which is provided at a windowpane of a vehicle.

An AM/FM receiving antenna provided at a windowpane of a vehicle, which is disclosed in Japanese Patent Laid-Open Publication No. 2003-152415, for example, has been proposed. There is a limit to a layout space for an antenna element because of a limited size of the windowpane of the vehicle. An AM electric wave and a FM electric wave have a different frequency band from one another. The AM electric wave has a longer wavelength than the FM electric wave. Herein, if an antenna element for receiving the FM electric wave was also able to function as an antenna element for receiving the AM electric wave properly, there could be an advantage of the layout space for the antenna element.

However, the above-described function of the antenna element for receiving the FM electric wave as the antenna element for receiving the AM electric wave would make it difficult to achieve compatibility of receiving sensitivity of both the AM and FM electric waves, so either one of receiving sensitivity might deteriorate.

SUMMARY OF THE INVENTION

An object of the present invention is to provide an AM/FM receiving antenna that can properly achieve the compatibility of receiving sensitivity of the AM and FM electric waves, having a smaller layout space for antenna elements.

According to the present invention, there is provided an AM/FM receiving antenna, which is provided at a windowpane of a vehicle, comprising an AM antenna element including an end portion as a power supply point and another end portion forming an open end, and an AM/FM antenna element connected to the AM antenna element via the power supply point, wherein a distance L between the end portion and the another end portion of the AM antenna element, a reduction ratio $\alpha$ of a material of the windowpane, a minimum wavelength $\lambda_{min}$ of a receiving FM frequency band, and a maximum wavelength $\lambda_{max}$ of the receiving FM frequency band meet a requirement equation of $\alpha\cdot\lambda_{min}/2 \leqq L \leqq \alpha\cdot\lambda_{max}/2$.

According to the above-described antennae, since the distance is set as $\alpha\cdot\lambda_{min}/2 \leqq L \leqq \alpha\cdot\lambda_{max}/2$, the AM electric wave is received by the AM antenna element and the AM/FM antenna element at receiving of the AM electric wave, while the FM electric wave is received by the AM/FM antenna element at receiving the FM electric wave because the antenna is configured as if the AM antenna element was taken off. Thus, while both the antenna elements function as an antenna at the receiving of the AM electric wave, the AM antenna element does not function as an antenna at the receiving of the FM electric wave. Accordingly, the layout space for the antenna elements can be properly small and the compatibility of receiving sensitivity of the AM and FM electric waves can be achieved.

According to an embodiment of the present invention, the above-described another end portion of the AM antenna element comprises a plurality of portions that are formed by a conductor constituting the AM antenna element which is divided into plural parts, and each distance between the end portion and the plurality of portions of the AM antenna element is $\alpha\cdot\lambda_{min}/2$ or greater and $\alpha\cdot\lambda_{max}/2$ or smaller. Thereby, an influence of the AM antenna element can be properly reduced at the receiving of the FM electric wave.

According to another embodiment of the present invention, a minimum distance $L_{min}$ and a maximum $L_{max}$ of distances between the end portion and the plurality of portions of the AM antenna element meet requirement equations of $L_{min}=\alpha\cdot\lambda_{min}/2$ and $L_{max}=\alpha\cdot\lambda_{max}/2$, respectively. Thereby, the influence of the AM antenna element can be properly reduced over an entire range of the FM frequency band received.

According to another embodiment of the present invention, the AM antenna element is formed substantially in a U shape. Thereby, the size of the AM antenna element can be properly small.

According to another embodiment of the present invention, the AM/FM antenna element is formed substantially in a rectangular shape. Thereby, the size of the AM/FM antenna element can be properly small.

According to another embodiment of the present invention, the AM antenna element and the AM/FM antenna element are provided at a rear windowpane with a plurality of heat wires constituting a defogger, and the AM antenna element and the AM/FM antenna element are disposed substantially in parallel to at least one of the heat wires and respectively have portions that are capacity-connected to the heat wires. Thereby, the heat wires can be used as an antenna element. Furthermore, since the AM antenna element and the AM/FM antenna element are not directly connected to the heat wires, it may not be necessary to provide a choke coil filter at the heat wires. Accordingly, a weight reduction and a cost reduction can be achieved.

Other features, aspects, and advantages of the present invention will become apparent from the following description which refers to the accompanying drawings.

DETAILED DESCRIPTION OF THE INVENTION

Hereinafter, a preferred embodiment of the present invention will be descried referring to the accompanying drawings.

Figure 1:
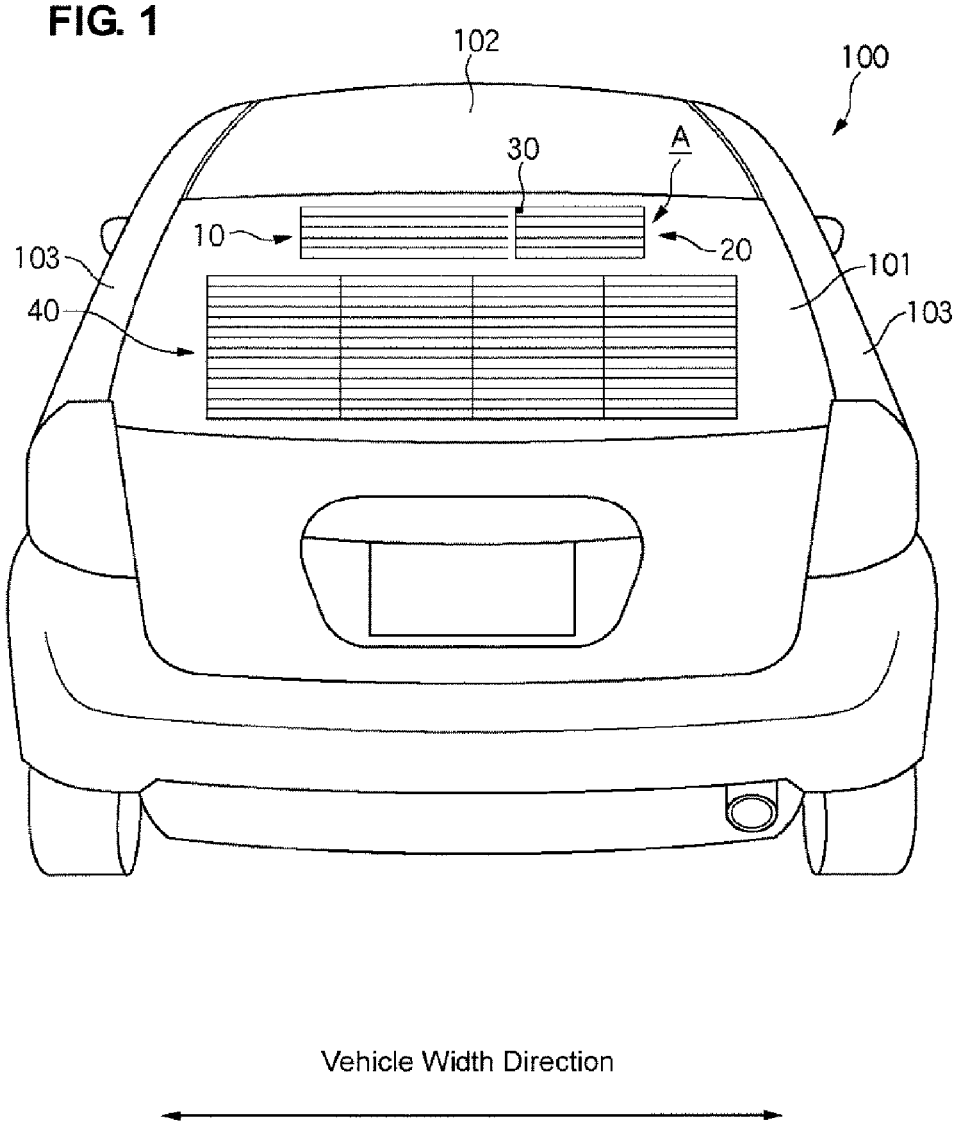
FIG. 1 is a back view of a vehicle 100 equipped with an AM/FM receiving antenna A according to an embodiment of the present invention.
Figure 2:
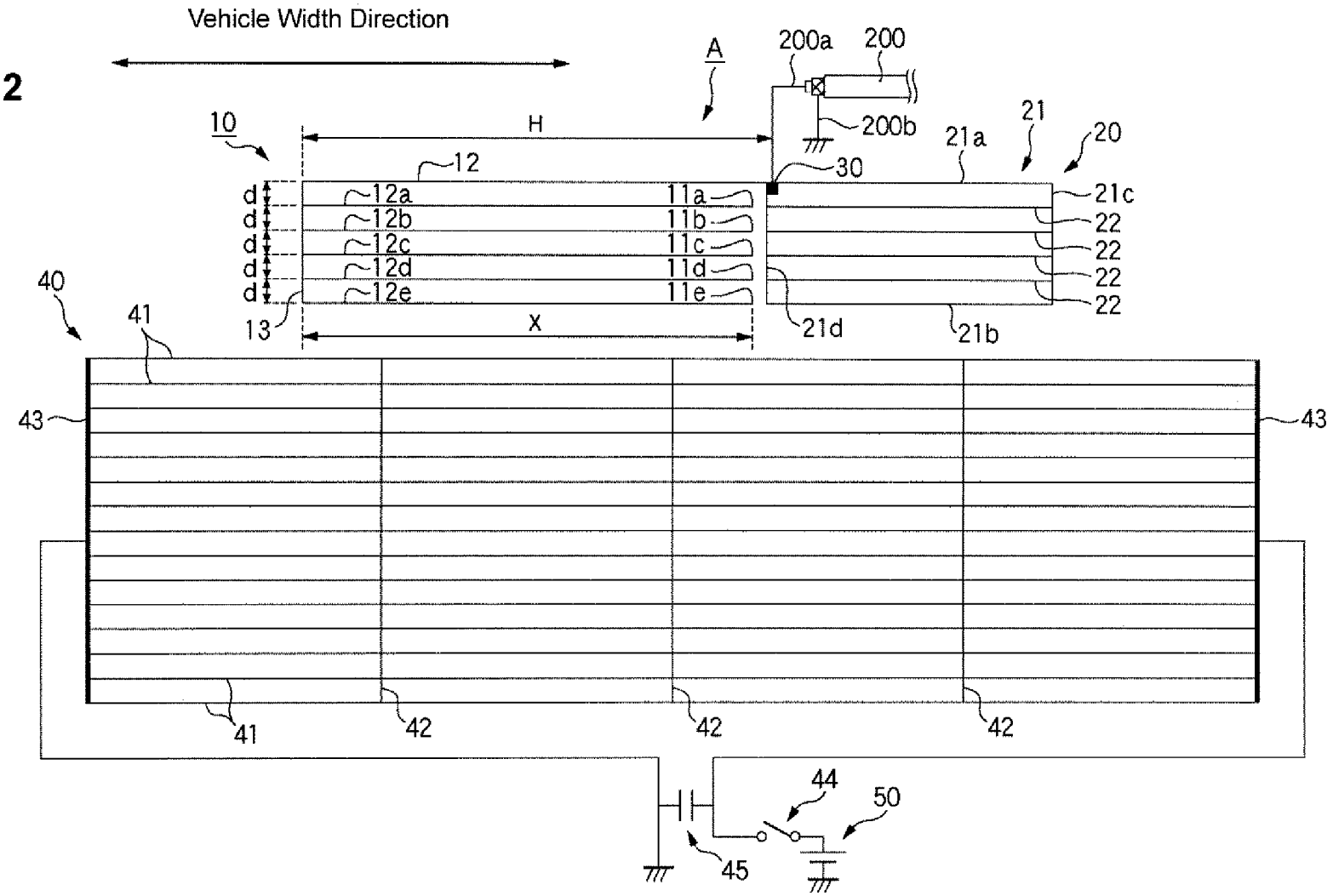
FIG. 2 is a circuit diagram of a receiving system using the AM/FM receiving antenna A.

FIG. 1 is a back view of a vehicle 100 equipped with an AM/FM receiving antenna A according to an embodiment of the present invention. FIG. 2 is a circuit diagram of a receiving system using the AM/FM receiving antenna A. The present embodiment shows an example in which the AM/FM receiving antenna A is applied to a rear windowpane 101 of the vehicle 100, but it may be applied to another type of windowpane such as a sun roof. The rear windowpane 101 is provided at an opening of a vehicle body that is enclosed by a roof 102 and rear pillars 103. The rear windowpane 101 of the present embodiment is made of a glass material, but it maybe made of a resin material.

The AM/FM receiving antenna A comprises an AM antenna element 10 and an AM/FM antenna element 20. These antenna elements 10, 20 are made of a conductor. These antenna elements may he disposed at the rear windowpane 101 with various ways. For example, a silver paste or the like are put on the rear windowpane 101, or a film antenna is formed by disposing conductors constituting the antenna elements 10, 20 on an adhesive film and then the film antenna is pasted on the rear windowpane 101.

A defogger 40 is provided at the rear windowpane 101, and the AM/FM receiving antenna A is disposed at another space of the rear windowpane 101 except a disposition space of the defogger 40. The AM/FM receiving antenna A is disposed above the defogger 40 of the present embodiment, but it may be located below the defogger 40.

The AM antenna element 10, as shown in FIG. 2, includes an end portion as a power supply point 30, and another end portion forming an open end that comprises a plurality of end portions 11*a*, 11*b*, 11*c*, 11*d* and 11*e* that are formed by the conductor constituting the AM antenna element 10 which is divided into plural parts. Further, the AM antenna element 10 has a straight element 12 that extends in a vehicle width direction, a plurality of straight elements 12*a*, 12*b*, 12*c*, 12*d* and 12*e* that are disposed in parallel to the element 12, and a perpendicular element 13 that interconnects respective end portions of the element 12 and the plural elements 12*a*-12*e* and extends perpendicularly to these elements.

The elements 12 and 12*a*-12*e* are disposed at regular intervals (a distance d). The element 12 has the power supply point 30, and the elements 12*a*-12*e* have the respective end portions 11*a*-11*e*. The AM antenna element 10 is formed substantially in a U shape from the end portion (power supply point 30) to the respective end portions 11*a*-11*e*, like a comb shape as a whole. Be shape of the AM antenna element 10 is not be limited to this shape, but this substantially U shaped antenna element 10 can provide it with a properly small size.

The AM/FM antenna element 20 is connected to the AM antenna element 10 via the power supply point 30, and it comprises an element 21 that is formed in a rectangular shape with straight elements 21*a*, 21*b* extending in the vehicle width direction and straight elements 21*c*, 21*d* extending perpendicularly to the vehicle width direction, and a plurality of straight elements 22 that are disposed at regular intervals within the element 21, extending in the vehicle width direction.

The elements 22 are provided ornamentally, and the element 21 mainly functions as an antenna. The shape of the element 21 is not be limited to this shape, but this rectangular shape of the element 21 can provide the AM/FM antenna element 20 with a properly smaller size than its just straight shape.

The power supply point 30 is connected to a feeder wire (line) 200. The feeder wire 200 of the present embodiment is comprised of a coaxial cables, and its power supply wire (an internal conductor) 200*a* is connected to the power supply point 30, and its shield wire (an external conductor) 200*b* is grounded (earthed) at the vehicle body. The feeder wire 200 is connected to a tuner, not illustrated, and signals (electric waves) received by the AM/FM receiving antenna A are supplied to the tuner. Herein, it may be preferable that an amplifier to amplify the signals from the AM/FM receiving antenna A be provided.

The defogger 40 comprises a plurality of straight heat wires 41 that are disposed at regular intervals, extending in the vehicle width direction, heat wires 42 that extend perpendicularly to the heat wires 41, and a pair of bus bars 43 that is provided at both sides and to which both ends of the heat wires 41 are connected. One of the bus bars 43 is grounded (earthed) at the vehicle body, and the other is connected to a battery 50 on board via an ON/OFF switch 44 of the defogger 40.

The element 12*e* of the AM antenna element 10 and the element 21*b* of the AM/FM antenna element 20 are disposed in parallel to the uppermost heat wire 41 so as to provide a capacity-connection between them (i.e., the elements 12*e*, 21*b* are capacity-connected to the heat wire 41). Accordingly, the heat wires 41, 42 of the defogger 40 can be made function as an antenna partially.

According to the present embodiment, the AM antenna element 10 and the AM/FM antenna element 20 are capacity-connected to the wires 41, 42. Thus, a proper anti-noise function can be properly kept without providing a choke coil filter like a system in which these antenna elements are directly connected to the wires via a stub. Further, providing a condenser 45 between the bus bars 43 and the vehicle body like the present embodiment can further improve the anti-noise function. The condenser 45 is provided to remove any noises that may be received by a power supply wire to the defogger 40. Since the choke coil filter is generally heavy and costly, the antenna without this filter may be superior in its weight reduction or const reduction.

Herein, while the present embodiment shows an embodiment in which the heat wires 41, 42 of the defogger 40 function as an antenna, another embodiment in which only the AM antenna element 10 and the AM/FM antenna element 20 function as an antenna may be adopted as well.

Next, dimensions of the AM antenna element 10 will be described. A gap between the end portion (power supply point 30) and the respective end portions 11*a*-11*e* of the AM antenna element 10 may constitute a transmission line passage with the vehicle body. Herein, in a case where the AM/FM antenna element 20 receives the FM electric wave having a wavelength $\lambda$, since the end portions 11*a*-11*e* form an open end, the distance between the end portion (poser supply point 30) and any of the end portions 11*a*-11*e* may be $\alpha\cdot\lambda/2$ ($\alpha$: a reduction ratio) and the impedance of the AM antenna element 10 for the FM electric wave having the wavelength $\lambda$ relative to the power supply point 30 may become infinitely great. As a result, this antenna may be equivalent to an antenna in which the AM antenna element 10 is taken (cut) off.

Accordingly, there can be provided a system by properly setting the dimensions of the AM antenna element 10, in which both the AM antenna element 10 and the AM/FM antenna element 20 (and the heat wires 41, 42 of the defogger 40) receive the AM electric wave, while the AM/FM antenna element 20 (and the heat wires 41, 42 of the defogger 40) receives the FM electric wave. Accordingly, the layout space for the AM/FM receiving antenna A can be properly small. Further, the AM electric wave having a relatively long wavelength that may require a longer antenna can be received properly, and the FM electric wave having a relatively short wavelength can be received without deteriorating its receiving sensitivity, so that the compatibility of receiving sensitivity of the AM and FM electric waves can be achieved.

Hereinafter, the proper dimensions of the AM antenna element 10 will be described specifically. When respective distances between the end portion (poser supply point 30) and the end portions 11*a*-11*e* of the AM antenna element 10 are indicated by L1-L5, these distances L1-L5 may be described as follows, referring to FIG. 2:

$$L1=H+d+X$$

$$L2=H+2d+X$$

$$L3=H+3d+X$$

$$L4=H+4d+X$$

$$L5=H+5d+X$$

Further, when a reduction ratio of a material of the rear windowpane 101 is indicated by $\alpha$, a minimum wavelength of a FM frequency band received by the AM/FM antenna A is indicated by $\lambda_{min}$, and a maximum wavelength of the FM frequency band received by the AM/FM antenna A is indicated by $\lambda_{max}$, the above-described distances L1-L5 are set so as to meet the following equations:

$$\alpha\cdot\lambda_{min}/2 \leqq L1, L2, L3, L4, L5 \leqq \alpha\cdot\lambda_{max}/2$$

Thereby, an influence of the AM antenna element 10 can be properly reduced at the receiving of the FM electric wave. For example, in Japan, the FM frequency band that can be received by the AM/FM receiving antenna A is between the minimum wavelength of approximate 333 cm (90 MHz) and the maximum wavelength of approximate 395 cm (76 MHz). Accordingly, in a case where the rear windowpane of the vehicle has the reduction ratio $\alpha$ of 0.8, the respective distances L1-L5 should be approximate 133 cm or more and approximate 158 cm or less.

The distance L1 is minimum ($L_{min}$) and the distance L5 is maximum ($L_{max}$). Thus, setting that L1=$\alpha\cdot\lambda_{min}/2$ and L5=$\alpha\cdot\lambda_{max}/2$ can meet the above-described requirement equation for all distances L1-L5. Further, the influence of the AM antenna element 10 can be properly reduced over an entire range of the FM frequency band received.

While the AM antenna element 10 has the plurality of end portions 11*a*-11*e* in the above-described embodiment, it may have a single end portion instead. In this case, the distance between the one end portion (power supply point 30) and the other end portion can be set to the one that corresponds to a middle frequency at the enter of the FM frequency band received. For example, in a case where the FM frequency band received is 76 through 90 MHz, the above-described distance will be approximate 144 cm that corresponds to the middle frequency of 83 MHz (wavelength: approximate 361 cm). However, this case would require a larger layout space for the AM antenna element 10 for its longer length. Thus, the above-described embodiment with the plurality end portions 11*a*-11*e* of the AM antenna element 10 may be preferable.

The present intention should not be limited to the above-described embodiments, and any other modifications and improvements may be applied within the scope of a spirit of the present invention.

What is claimed is:

1. An AM/FM receiving antenna, which is provided at a windowpane of a vehicle with a plurality of heat wires constituting a defogger, comprising:

an AM antenna element including an end portion as a power supply point and another end portion forming an open end; and an AM/FM antenna element connected to the AM antenna element via the power supply point, wherein the AM antenna element and the AM/FM antenna element are provided at another space of the windowpane except a disposition space of the defogger in such a manner that the AM antenna is located on one side and the AM/FM antenna element is located on the other side in a vehicle width direction, a distance L between the end portion and the another end portion of the AM antenna element, a reduction ratio $\alpha$ of a material of the windowpane, a minimum wavelength $\lambda_{min}$, of a receiving FM frequency band, and a maximum wavelength $\lambda_{max}$ of the receiving FM frequency band meet a requirement equation of $\alpha\cdot\lambda_{min}/2 \leqq L \leqq \alpha\cdot\lambda_{max}/2$.

2. The AM/FM receiving antenna of claim 1, wherein said another end portion of the AM antenna clement comprises a plurality of portions that are formed by a conductor constituting the AM antenna element which is divided into plural parts, and each distance between the end portion and the plurality of portions of the AM antenna element is $\alpha\cdot\lambda_{min}/2$ or greater and $\alpha\cdot\lambda_{max}/2$ or smaller.

3. The AM/FM receiving antenna of claim 2, wherein a minimum distance $L_{min}$ and a maximum $L_{max}$ of distances between the end portion and the plurality of portions of the AM antenna element meet requirement equations of $L_{min}=\alpha\cdot\lambda_{min}/2$ and $L_{max}=\alpha\cdot\lambda_{max}/2$, respectively.

4. The AM/FM receiving antenna of claim 2, wherein said AM antenna element is formed substantially in a U shape.

5. The AM/FM receiving antenna of claim 1, wherein said AM/FM antenna element is formed substantially in a rectangular shape.

6. The AM/FM receiving antenna of claim 1, wherein the AM antenna element and the AM/FM antenna element are disposed substantially in parallel to at least one of the heat wires and respectively have portions that are capacity-connected to the heat wires.

7. An AM/FM receiving antenna, which is provided at a windowpane of a vehicle, comprising:

an AM antenna element including an end portion as a power supply point and another end portion forming an open end; and an AM/FM antenna element connected to the AM antenna element via the power supply point, wherein a distance L between the end portion and the another end portion of the AM antenna element, a reduction ratio $\alpha$ of a material of the windowpane, a minimum wavelength $\lambda_{min}$ of a receiving FM frequency band, and a maximum wavelength $\lambda_{max}$ of the receiving FM frequency band meet a requirement equation of $\alpha\cdot\lambda_{min}/2 \leqq L \leqq \alpha\cdot\lambda_{max}/2$, said another end portion of the AM antenna element comprises a plurality of portions that are formed by a conductor constituting the AM antenna element which is divided into plural parts, and each distance between the end portion and the plurality of portions of the AM antenna element is $\alpha\cdot\lambda_{min}/2$ or greater and $\alpha\cdot\lambda_{max}/2$ or smaller.

8. The AM/FM receiving antenna of claim 7, wherein a minimum distance $L_{min}$ and a maximum $L_{max}$ of distances between the end portion and the plurality of portions of the AM antenna element meet requirement equations of $L_{min}=\alpha\cdot\lambda_{min}/2$ and $L_{max}=\alpha\cdot\lambda_{max}/2$, respectively.

* * * * *